United States Patent [19]

Frank

[11] 4,005,839

[45] Feb. 1, 1977

[54] RAILROAD TURNOUTS

[75] Inventor: Earl E. Frank, Tallman, N.Y.

[73] Assignee: Abex Corporation, New York, N.Y.

[22] Filed: Sept. 22, 1975

[21] Appl. No.: 615,390

[52] U.S. Cl. ..... 246/415 R; 246/427; 246/432; 246/434; 246/435 R; 246/468

[51] Int. Cl.[2] ..... E01B 7/14

[58] Field of Search ..... 104/15; 238/17, 20; 246/415 R, 427, 432, 435 R, 435 A, 444, 468, 434

[56] References Cited

UNITED STATES PATENTS

| | | | |
|---|---|---|---|
| 232,171 | 9/1880 | Brahn | 246/432 X |
| 444,633 | 1/1891 | Grubbs | 246/432 |
| 1,818,885 | 8/1931 | Enstrom | 246/435 R |

FOREIGN PATENTS OR APPLICATIONS

| | | | |
|---|---|---|---|
| 519,666 | 5/1953 | Belgium | 246/415 R |
| 450,414 | 8/1948 | Canada | 246/415 R |
| 2,103,176 | 7/1972 | Germany | 246/468 |
| 97,763 | 1/1961 | Norway | 246/415 R |
| 62,172 | 2/1922 | Sweden | 246/435 R |

*Primary Examiner*—Stephen G. Kunin
*Attorney, Agent, or Firm*—Kinzer, Plyer, Dorn & McEachran

[57] ABSTRACT

A railroad turnout including a switch having runoff plates with stop lugs spaced farther apart than the width of the switch point base so that flexure of the switch points downstream of the heel spread is permitted. Floating heel blocks are affixed to the stock rails at the heel point to maintain the conventional heel spread. A smooth ride through the turnout is further assured by additional switch rods, uniform risers in the switch and guard rails associated with the frog of the turnout.

8 Claims, 8 Drawing Figures

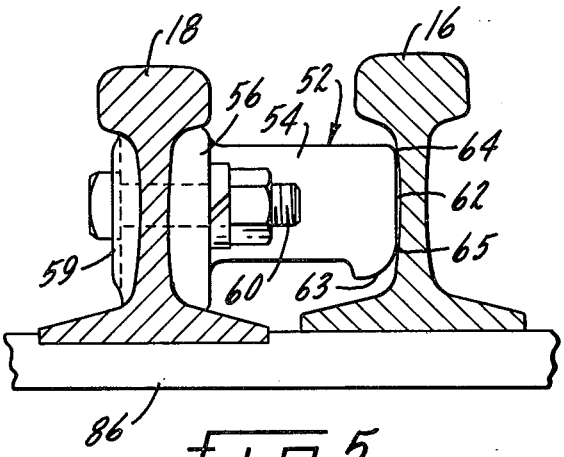
fig.5.
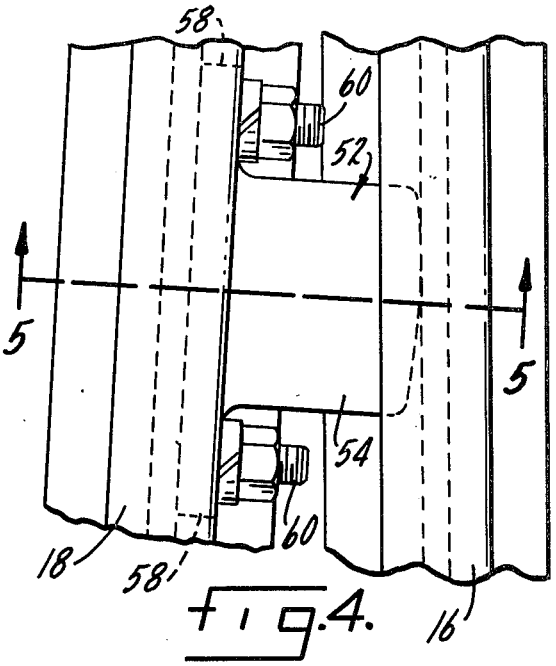
fig.4.
fig.6.
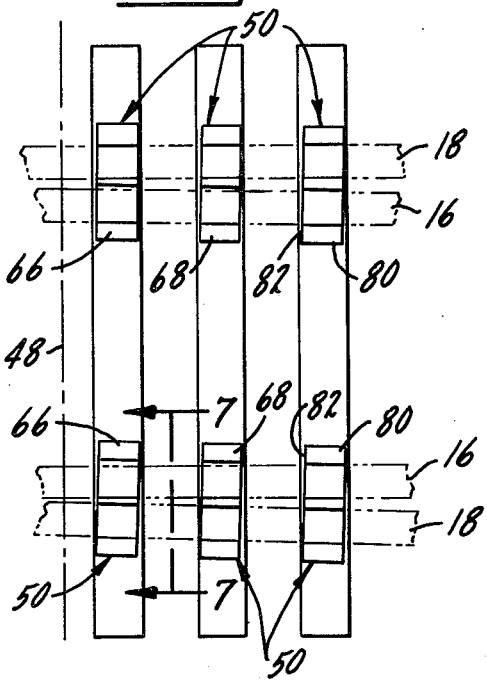
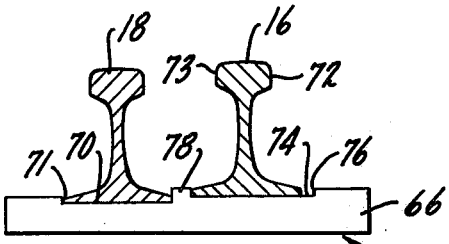
fig.7.
fig.8.
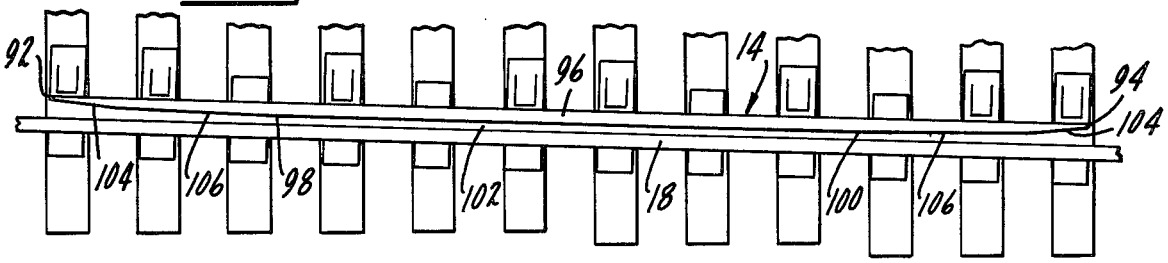

RAILROAD TURNOUTS

This invention relates to a railroad turnout inclusive of a switch, frog and guard rails.

More particularly, the present invention relates to an improved railroad turnout which requires less maintenance and which may be traversed by a railroad car in a smoother manner with substantially less lateral impact against the turnout elements.

The railroad switch in a conventional turnout is characterized by a pair of movable switch points commencing at the point of switch and terminating at the heel. In the conventional switch, the heel is in effect spliced to the abutting stock rails by joint bars. The splice is maintained by through bolts.

The largest track systems in the United States have many thousands of turnouts. Considerable maintenance is required merely from the standpoint of inspection and maintenance of the turnouts.

While it has heretofore been proposed to reduce turnout maintenance by welding the switch points to adjacent ends of the closure rails, the arrangement has been such that the switch points are flexed, when throwing the switch, commencing at the conventional heel spread. In other words, in the known welded switch, the length of flexing has been virtually the same as in the conventional arrangement. In some instances, the force required to throw the welded switch points is considerably higher than the force to throw the conventional switch. This is so for the reason that the switch point rails must actually be bent in the welded switch compared to merely pivoting the switch point at the heel spread of the standard switch. Nevertheless from the standpoint of eliminating the joint bars and connector bolts, the proposition of the welded switch embodies considerable merit.

One object of the present invention is to considerably improve the efficiency of operating a welded switch by extending the point of flexure and to permit this extension to be effectively and practically accomplished by employing a combination of novel runout plates and heel blocks as hereinafter disclosed in detail. It may appear at first that I have eliminated maintenance at the heel spread (by eliminating the joint bars and bolts) while enlarging maintenance in terms of the aforementioned heel blocks and runout plates. This is by no means the case because the parts required at the heel spread of conventional switches are always flexed when the switch is thrown, resulting in metal fatigue (in the joint bars) and subject to loosening (the connector bolts) whereas the heel blocks and the altered runout plates with which I am concerned may be viewed as static parts, comparatively speaking.

Any railroad turnout in its very nature includes a frog where the main rail sections cross one another. It has been found that railroad car wheels exert lateral impact forces against the frogs due to the hunting or crabbing action of the wheels which is further accentuated upon entry into conventional frogs. The common practice today is to have the guard rails staggered so that the frog flare jerks the wheel over to accommodate its position and when the wheel enters the guard rail flare, it is jerked over in the other position. The result is that the frog moves approximately one-quarter inch in either direction which puts excessive loading on the frog and its associated parts resulting in misalignment and exceptional wear. It is therefore an object of the present invention to minimize the lateral thrust against the frog by providing a substantially improved guard rail which dampens out the hunting action of the railroad car wheels prior to entry into the frog flangeway.

Similarly, an object of the present invention is to further assure a smooth transition over the frog.

In the switch of a turnout, a series of switch plates support the switch points between the point of switch and heel spread. Some prior switches have been installed with a series of switch plates known as graduated risers. In these switches, the switch rails are maintained generally one-quarter inch above the stock rails only from the end of the top planing through approximately one-fifth of the length of the switch rail, ending at a point approximately three-fifths of the switch length from the point, where a vertical bend is made in the switch rail and the risers of the plates downstream of this point are successively diminished so that the switch and stock rails become level before reaching the heel spread. In regards to a railroad car traversing the switch, as the wheels on one side ride on a level stock rail, the opposite wheels encounter the vertical bend thereby tending to induce a rocking motion into the railroad car. It is therefore an object of the present invention to maintain good riding through the switch by providing in combination with the features above, a series of uniform risers for supporting the switch points and providing a gradual runoff.

Specifically, in accordance with the present invention, flexure of the switch points downstream of the heel spread is achieved by the use of runoff plates having stop lugs spaced laterally a greater distance than the lateral dimension of the base of the switch point rails. To maintain the proper heel spread in the switch, a floating heel block is affixed to the gauge side of each stock rail, thereby acting as stops for the lateral movement of the switch points. The lateral thrust of railroad car wheels may be dampened out prior to entry into the frog flangeways by guard rails of such length as to extend beyond the throat of the frog in one direction while being substantially co-terminal with the heel end of wing rails in the other direction. Smooth transition through the turnout may be further enhanced by uniform risers for supporting the switch points between the point of switch and heel spread, and frog arms of sufficient length that both the toe length and heel length of the frog exceed the longitudinal distance between the throat of the frog and the heel end of the wing rails.

FIG. 4 is a greatly enlarged plan view of the right hand heel block of FIG. 2.

FIG. 5 is a sectional view taken along line 5—5 of FIG. 4.

FIG. 6 is an enlarged plan view of the runoff plates downstream of the heel spread as in FIG. 2.

FIG. 7 is an end view, partly in section, taken along line 7—7 of FIG. 6.

FIG. 8 is an enlarged plan view of the right hand frog guard rail, as in FIG. 1.

Figures 1, 2, 3:
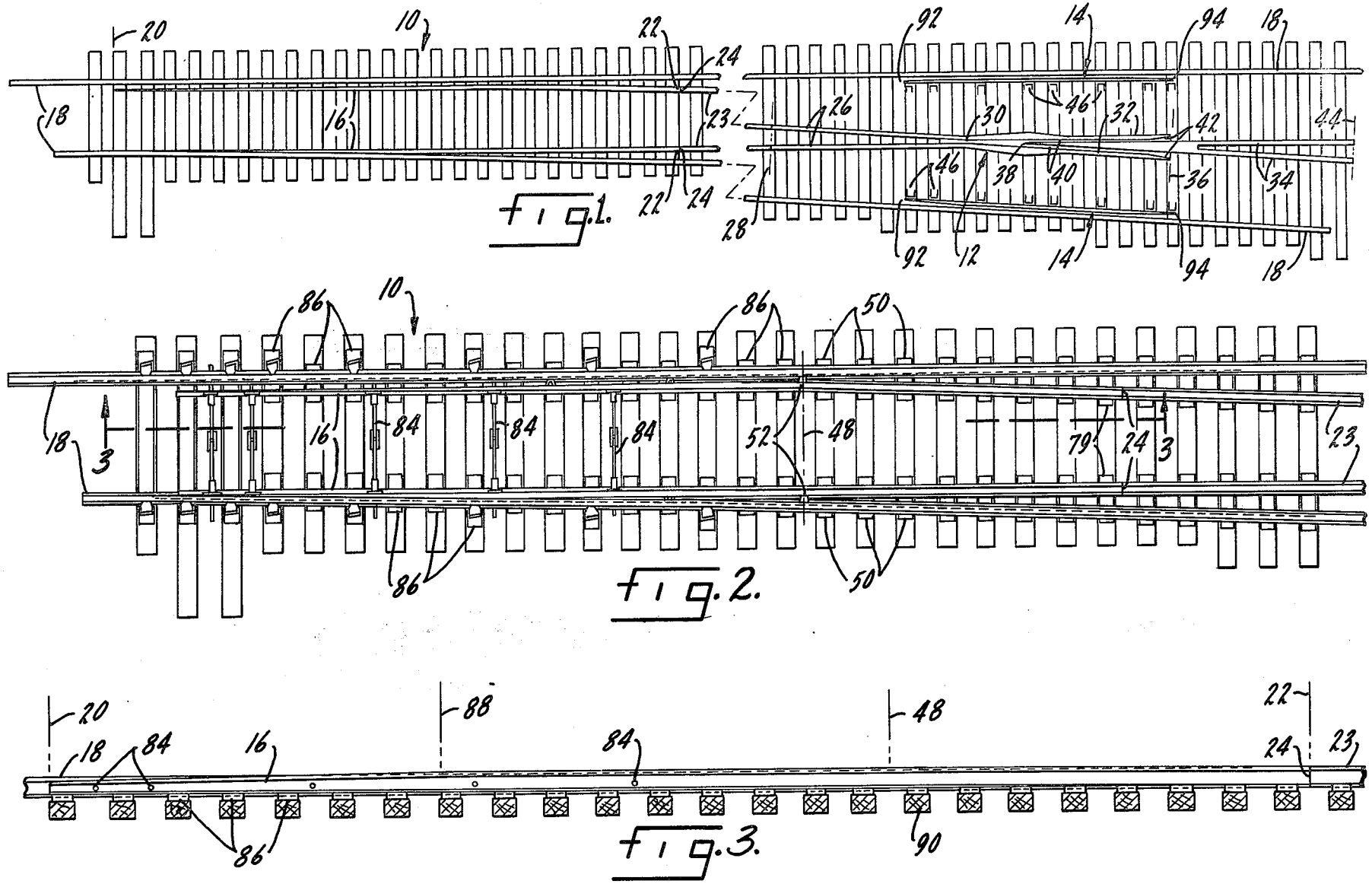
FIG. 1 is a partially fragmented plan view of a railroad turnout according to the present invention inclusive of a switch, frog, and frog guard rails.
FIG. 2 is an enlarged and further detailed plan view of the switch shown in FIG. 1.
FIG. 3 is a slightly enlarged elevation view of the switch shown in FIG. 2.

A railroad turnout constructed in accordance with the present invention is shown in FIG. 1. The turnout forms the connection of one track with another and consists of a switch 10, a frog 12, two guard rails 14 and various connecting and operating parts described below. Throughout this description, the trackwork comprising the turnout is referred to by terminology commonly known in the railroad industry. The switch consists essentially of two switch point rails or switch points 16, known as the right hand and the left hand points, both being reciprocable in unison between two outer stock rails 18. The longitudinal position of the tapered ends of the switch points is called the point of switch 20. The opposite ends are herein referred to as the heel ends 22 of the switch points. Right and left hand designations are assigned as if one were standing at the point of switch looking downstream toward the heel end of the switch points and frog. The heel ends of the switch points are rigidly connected to closure rails 23, by field welds 24.

In the right hand turnout shown in FIG. 1, so-called because one track curves to the right away from another straight track, the left hand stock rail and right hand closure rail extend straight downstream whereas the left hand closure rail and right hand stock rail curve along a generally uniform arc (not shown) toward the frog. The switch closure rails are rigidly connected to wing rails 26 at the toe end 28 of the frog. The wing rails converge toward the throat 30 of the frog. The throat is defined as the point where the gauge lines of the frog intersect the guard lines of the flared frog wings 32. The guard lines coincide with the guard face of the flangeway prior to the flared frog wings. A pair of heel rails 34 having gauge lines which converge toward the frog point, lie downstream of the heel end 36 of the flared frog wings. The point of frog 38 is defined as the point where the spread between the gauge lines of the frog is one-half inch.

A frog is introduced at the intersection of two running rails to permit the flanges of wheels moving along one of them to pass across the other. It supports the wheels over the missing track surface between the throat and point of frog, and provides flangeways 40 for the wheel flanges when passing over the point. As shown in FIG. 1, the heel ends of the flared frog wings are flared outwardly to provide frog flares 42. A frog is measured by its toe length which extends from the toe end of the wing rails to the point of frog and its heel length which extends from the point of frog to the heel end 44 of the heel rails.

Guard rails 14 are positioned laterally adjacent the frog to prevent the wheel flanges from striking the point of frog. Both ends of the guard rails are flared to align the wheels into their proper course without shock, as described in greater detail below. Similarly, both guard rails require adequate braces 46 to support them against the side thrust of traffic.

Referring specifically to switch 10, as shown in FIG. 2, an additional reference point is necessary to describe the present invention, namely the theoretical heel spread 48. In conventional switches, the switch points end at the heel spread where they are rigidly bolted to extended versions of the closure or lead rails 23. A stationary heel block is interposed between the rails to maintain the fixed distances between their gauge lines, 6¼ inches for example, at the heel spread. In the present invention, the switch points extend downstream beyond the theoretical heel spread to where they are connected by field welds 24 to the ends of the closure rails. Downstream of the heel spread, the switch points are supported on runoff plates 50. Although welded switches are known, such switches have been used in connection with conventional runoff plates and heel blocks.

In accordance with the present invention, improved heel blocks and runoff plates have been provided to allow additional rail downstream of the heel point to spring or flex when the switch is thrown. Because some lateral movement of the switch points is permitted at the heel point, floating heel blocks 52 are installed between the switch points and stock rails to maintain the proper heel spread between the rails on the side to which the switch is thrown, the right side in FIG. 2 for example. Since both heel blocks are identical and positioned laterally opposite one another, only the right hand floating heel block, shown in FIGS. 4 and 5, is herein described. It consists of a generally solid center block 54 protruding laterally from a widened base portion 56 forming side flanges 58 adjacent each side of the center block. The outer side of base 56 conforms in shape to the web of stock rail 18 against which it is engaged in its installed position. A bearing plate 59 engages the opposite side of the stock rail web. Aligned holes are formed through the floating heel block flanges, the stock rail web and the bearing plate 59. Heel block bolts 60 are inserted through the aligned holes and conventional nuts and lock washers are used to tightly fasten the floating heel block against the stock rail. The inner face 62 (FIG. 5) of the floating heel block is vertically generally flat but blends into an arcuate lower lip portion 63 which extends longitudinally along the inner edge of center block 54. Although floating heel block 52 thus engages the switch point 16 along the two vertically spaced lines of contact 64 and 65, it may, in other embodiments, conform exactly to the outer face of the switch point web or provide one or two points of contact. The importance of such contact is to provide lateral support for the switch point to maintain the heel spread at the heel point when the switch point is engaged against it. The floating heel block is of course generally centered longitudinally at the theoretical heel spread.

Although the switch points are no longer fastened to the stock rails with the heel blocks of the present invention, flexure downstream of the heel point would still be resisted by the stop lugs of conventional runoff plates. Thus in accordance with the present invention, improved run-off plates 66 and 68 (FIG. 6) are secured to the ties immediately downstream of the heel spread. The cross section of plate 66 is shown in FIG. 7. Stock rail 18 is seated in a cut out section or slot 70 which is bounded on the outside by a stock rail shoulder 71. The switch point is elevated generally one-quarter inch above the stock rail on a riser section 74. The sides of the switch point are referred to as the gauge side 72 and field side 73. Lateral movement of the switch point on the riser portion is confined on the gauge side 72 by a switch point shoulder or stop lug 76 and on the field side 73 by stop lug 78. It will be noticed that stop lugs 76 ad 78 are spaced laterally a greater distance than the lateral dimension of the base of the switch point rail 16 so that free movement of the switch point is permitted. It is preferred that the stop lugs 76 and 78 are the abutments defining a milled slot in an integral runoff plate, as shown in FIG. 7. In other embodiments however, stop lug 76 may be eliminated so that riser section 74 may extend laterally to the gauge side of the runoff plate. The stop lugs furthermore may be adjustable or removable barriers in other embodiments.

Runoff plates which provide for this lateral movement or flexure may be inserted on several ties downstream of the theoretical heel spread. All of such plates may have a uniform width of riser section 74 but under the present invention the lateral spacing between the stop lugs of the runoff plates decreases progressively as the distance from the heel point increases. Furthermore, it is preferred that the spacing between the stop lugs of at least the pair of runoff plates 79 (FIG. 2) immediately upstream of the welded joints 24 is such that no flexure is permitted at the welded joints. In other words the spacing is equal to the width of the switch point base.

The first pair of runoff plates downstream of the theoretical heel spread which provide for no lateral movement of the switch points are significant because the upstream edge of these plates defines the point of flexure or beginning of the floating heel of the switch point. Referring to FIG. 6, runoff plates 80 have stop lugs which rigidly confine the lateral movement of the switch points and hence, when the switch is thrown, the switch points will flex or bend along their entire length back to the upstream edge 82 of plates 80.

In accordance with the preferred embodiment, the stop lugs of plates 68 are spaced apart by a slightly shorter distance than the spacing of the lugs on plate 66. This is so because plates 68 are closer to the point of flexure or pivoting of the switch points and hence, less deflection will occur there than at a point further upstream of the point of flexure. For example, if switch 10 has a 4¾ inch throw, being the distance each switch point traverses laterally at the point of switch in moving from one position to the other, the lateral deflection of the switch points at each plate upstream of the point of switch will be a function of its distance from the point of flexure and certainly less than 4¾ inches. The idea with the spacing of the stop lugs on the runoff plates is to permit all of the natural deflection incident to bending of the switch points but to provide lateral support at the end of the deflection to resist further lateral movement due to the side thrust of traffic on the rails. Although only two pair of runoff plates 66 and 68, which permit flexure, are shown in the drawing, a single pair could be used or any number greater than two. Similarly, flexure may in some cases be permitted downstream of the welded joint but the preferred design is to rigidly confine the switch points between the stop lugs of at least the pair of runoff plates 79 immediately upstream of the welded joint.

Since the runoff plates of the present invention provide a greater bending length of the switch points for a given switch length, less force is required to throw the switch. If the throw of the switch remains constant at 4¾ inches for example, the flexure which is required in any unit length of the rail for throwing the switch actually decreases as the bending length of the rail increases.

Referring again to FIG. 2, switch 10 includes several switch rods 84 to hold the switch points in correct relation with each other and to keep them from rising. Although the structure and use of switch rods is well known in the railroad industry, the number of rods interposed between the switch points in accordance with the present invention may exceed the number commonly recommended according to conventional railroad practice. Such additional rods bolster the structural rigidity and improve the alignment of the switch points without sacrificing the increased flexibility due to the improved runoff plates.

The plates which support the switch points between the point of switch and heel point are called switch plates or risers. Switch plates 86 (FIGS. 2 and 3) are of the type known as uniform risers. These switch plates have a uniform height of riser, which is the additional thickness of the plate supporting the switch point. The switch rails are thereby maintained one-quarter inch above the base of the stock rails from the end point 88 of the switch point to beyond the theoretical heel spread 48 and tie 90 back of the theoretical heel spread of the switch. From this point the heights of the risers are diminished by easy graduations until the switch point and the stock rails become level. In switches with the graduated risers, a vertical bend is made in the switch rail upstream of the heel joint so that the switch and stock rails become level before reaching the heel spread. The uniform risers are preferred since they eliminate the vertical bend which tends to induce a canting or rocking action in the railroad car which traverses such a switch. This rocking action tends to shift the weight of the car from side to side and thus from rail to rail, thereby exerting excessive weight on one rail disturbing the overall equilibrium of the car as it traverses the turnout.

Referring again to FIG. 1, and specifically to the frog guard rails 14, it is apparent that the toe ends 92 of the guard rails are positioned upstream beyond the throat 30 of the frog and that the heel ends 94 are positioned generally opposite the heel end 36 of the wing rails so that the wing rails and frog guard rails are substantially co-terminal at the heel end. Both ends of the guard rails are flared generally away from the adjacent stock rail along exceptionally long entrance flares, as shown in FIG. 8. A long tangent portion 96 of the guard rail, the outer surface of which defines the guard lines, runs longitudinally parallel to the stock rail between points 98 and 100 at the toe and heel ends, respectively. The tangent portion 96 and the adjacent stock rail together define the guard rail flangeway 102 between them which is generally a standard 1¾ inches wide. The guard rail flares shown in the drawing are each cut along two planes thereby presenting a wide entrance angle 104 which merges into a more narrow inner angle 106. Although the flared ends of guard rails 14 are all similar, it may be desired to have steeper flared angles at one end or the other to accommodate particular trackwork situations. The important point is that the tangent portion 96 extends upstream beyond the throat of the frog and, thereafter merges into an exceptionally long entrance flare. This has been done to assist in dampening out the hunting action of the railroad car wheels as they go down the track, so that upon entry into the frog flangeway the lateral thrust normally transmitted to the frog during the passage of a railroad car. Furthermore, with the long entrance flare on the heel end of the guard rail positioned laterally opposite a relatively long flare 42, the wheels of a railroad car will be immediately positioned upon simultaneously engaging both flares, and thus traverse the frog with less impact of the wheel on the guard rail.

Finally, each of the elements described above cooperate in combination to provide an improved railroad turnout which requires less maintenance and which provides a smoother ride for a car traversing the turnout. The added flexibility of the switch points due to the spaced lugs on the runoff plates provides for easier throwing of the switch and smooths out the angle of bend at the point of flexure. The additional flexibility of the switch points not only eliminates the conventional troublesome heel joints but also provides less chance of fatigue failure of the switch points at the point of flexure than conventional switches. The floating heel blocks cooperate with the runoff plates to allow for the additional flexibility while maintaining the conventional heel spread of that switch point which is positioned to take the load of traffic. The additional switch rods preserve the rigidity of the switch points thereby preventing lateral deformation in response to the load of traffic. As an integral part of the turnout, the frog arms on both the toe and heel ends are sufficiently long to provide smooth propagation of the wave action that is normally traveling longitudinally in the rail prior to the moving car. In combination with field welded joints, the extended frog arms provide an exceptionally smooth ride. The frog guard rails with extended tangent portions and exceptionally long entrance flairs dampen out the hunting action or lateral thrust of the railroad car wheels prior to entry into the frog flangeway, thereby preventing movement of the frog during the passage of a railroad car.

It will be understood that modifications and variations may be effected without departing from the scope of the novel concepts of the present invention.

I claim:

1. In a railroad turnout comprising a switch having a pair of switch point rails which extend from switch points at one extremity to a heel spread at the other extremity where they are attached to a pair of closure rails for diverting traffic from one set of main stock rails to another, all the rails having a wide base joined to a head by an intermediate web, and in which the switch has a heel spread downstream of the switch points defined by a heel block interposed between each switch point rail and the adjacent stock rail, the improvement comprising welded joints between the switch point rails and closure rails downstream of the heel spread of the switch characterized in that between the heel spread and welded joints the bases of the switch point rails repose on runoff plates having stop lugs spaced laterally a greater distance than the lateral dimension of the base of the switch point rails, said distance being sufficient to allow full flexure of the switch point rails beyond the heel spread providing easier movement of the switch point rails when throwing the switch, and further characterized in that the spacing between the stop lugs of each runoff plate immediately upstream of the welded joints is generally equal to the width of the base of the switch point rails thereby preventing flexure at the welded joint.

2. The improvement of claim 1 further characterized in that the lateral spacing between stop lugs of the runoff plates decreases progressively in plates interposed between the heel spread and the welded joints.

3. The railroad turnouts of claim 1 further characterized in that a floating heel block is affixed to the gauge side of each stock rail, the floating heel blocks acting as stops for the lateral movement of the switch points to thereby establish the proper heel spread on the side to which the switch is thrown.

4. The railroad turnouts of claim 3 further characterized in that the floating heel block comprises a wide base, the outer side of which generally conforms to the web of the stock rail, a center block portion protruding from the inner side of the base and adapted to engage the web of the switch point to maintain the heel spread of the switch, said base forming flanges extending longitudinally from each side of the center block and having holes therethrough adapted to receive bolts fo fastening the floating heel block to the stock rail web.

5. The railroad turnouts of claim 3 further characterized by and including a plurality of switch rods interposed between the switch points upstream of the heel spread and spaced apart from one another thereby rigidly maintaining the fixed spaced relationship between the switch points despite the increased flexibility of the switch points permitted by said runoff plates.

6. The railroad turnout of claim 3 further characterized in that uniform risers of uniform height support the switch points between the point of switch and the heel spread.

7. In a railroad turnout comprising a switch located between a pair of stock rails, a frog, and frog guard rails, and wherein the switch includes both switch point rails and closure rails joined thereto, with each switch point rail spaced from the adjacent stock rail by an interposed heel block, and wherein the switch point rails are joined to the closure rails at what is termed the heel spread, the combination of:

welded joints between the switch point rails and closure rails; each of the rails having a wide base joined to a head by an intervening web;

runoff plates between the heel spread and welded joints and having stop lugs spaced farther apart than the width of the base of the switch point rails thereby allowing flexure of the switch point rails downstream of the heel spread;

the frog being located downstream of the welded joints and having frog arms comprising heel rails and wing rails with toe ends and heel ends; and guard rails positioned parallel to the stock rails which are on opposite sides of the frog and said guard rails having straight portions extending parallel to the respective stock rails which straight portions are of such length as to extend beyond the throat of the frog in one direction to the wing rails in the opposite direction thereby providing lateral support for dampening out the lateral thrust of railroad car wheels before the wheels enter the frog.

8. The railroad turnout of claim 7 further characterized in that the guard rails have flared ends at the extremities of the straight portions, said flared ends presenting a wide entrance angle merging into a more narrow inner angle.

* * * * *

UNITED STATES PATENT AND TRADEMARK OFFICE

CERTIFICATE OF CORRECTION

PATENT NO. : 4,005,839

DATED : February 1, 1977

INVENTOR(S) : Earl E. Frank

It is certified that error appears in the above–identified patent and that said Letters Patent are hereby corrected as shown below:

Claim 1, line 3 thereof, change "spread" to --end--.

Claims 3, 4 and 5, line 1 thereof, change "turnouts" to -- turnout -- in each instance.

Claim 4, line 9 thereof, change "fo" to -- for --.

Claim 7, line 6 thereof, after "heel" insert -- spread --; line 8 thereof, change "spread" to --end--.

Signed and Sealed this

Nineteenth Day of April 1977

[SEAL]

*Attest:*

RUTH C. MASON
*Attesting Officer*

C. MARSHALL DANN
*Commissioner of Patents and Trademarks*